US009676204B2

(12) United States Patent
Nohara

(10) Patent No.: US 9,676,204 B2
(45) Date of Patent: Jun. 13, 2017

(54) PRINTER HAVING LIGHT SHIELDING STRUCTURE PREVENTING EXTERNAL LIGHT FROM ENTERING INTO HOUSING

(71) Applicant: Brother Kogyo Kabushiki Kaisha, Nagoya-shi, Aichi-ken (JP)

(72) Inventor: Shuhei Nohara, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/252,260

(22) Filed: Aug. 31, 2016

(65) Prior Publication Data

US 2017/0080718 A1 Mar. 23, 2017

(30) Foreign Application Priority Data

Sep. 18, 2015 (JP) ..... 2015-185810

(51) Int. Cl.
*B41J 13/10* (2006.01)
*B41J 2/335* (2006.01)
*B41J 13/00* (2006.01)

(52) U.S. Cl.
CPC ..... *B41J 2/33505* (2013.01); *B41J 13/0027* (2013.01); *B41J 13/10* (2013.01); *B41J 13/103* (2013.01)

(58) Field of Classification Search
CPC combination set(s) only.
See application file for complete search history.

(56) References Cited

U.S. PATENT DOCUMENTS

2014/0043422 A1* 2/2014 Takahashi ..... B41J 3/36 347/171

FOREIGN PATENT DOCUMENTS

JP 2000-043352 A 2/2000
JP 2012-030435 A 2/2012

OTHER PUBLICATIONS

Computer generated translation of JP 2012-030435, published on Feb. 2012.*

* cited by examiner

*Primary Examiner* — Huan Tran
(74) *Attorney, Agent, or Firm* — Banner & Witcoff, Ltd.

(57) ABSTRACT

A printer includes a casing in which a confronting portion is provided between a platen roller and a thermal line head. The casing has an opening. A guide member provides an inlet passage in the casing and includes a plurality of ribs and a flat surface portion. The ribs are spaced away from each other in a widthwise direction of a sheet. The ribs are in contact with the sheet to guide the sheet. The flat surface portion is positioned at a portion other than the plurality of ribs. An optical sensor is provided to optically detect the sheet. A light shielding member is provided in the casing and protrudes toward the inlet passage at a position closer to the opening than the optical sensor to the opening. The light shielding member has a protruding end in intimate contact with the flat surface portion.

9 Claims, 11 Drawing Sheets

170
a
a
GR
A
120C
120B
120A
120
130R
113
111a
131
170
140
150
114
L1
111
GR
120B
120A
S
S1
S2
170
170B
170A
t1
t2
w
120C
ΔH
H1
H2
50
132
131
140
130L
170
11

PRINTER HAVING LIGHT SHIELDING STRUCTURE PREVENTING EXTERNAL LIGHT FROM ENTERING INTO HOUSING

CROSS REFERENCE TO RELATED APPLICATION

This application claims priority from Japanese Patent Application No. 2015-185810 filed Sep. 18, 2015. The entire content of the priority application is incorporated herein by reference.

TECHNICAL FIELD

The present disclosure relates to a portable printer that performs printing on an image recording medium.

BACKGROUND

Japanese Patent Application Publication No. 2012-30435 discloses a portable printer for printing an image on an image recording medium such as a sheet. According to the disclosed printer, a platen roller and a thermal line head those provided in a housing perform printing on the sheet fed into the housing from an outside.

That is, the sheet is inserted into an interior of the housing through an opening (insertion opening) formed at an upper portion of the housing, and then introduced into a confronting portion between the platen roller and the thermal line head while being guided by a guide member. The thermal line head generates a printing image on the sheet that is conveyed by the platen roller. In this case, sheet conveyance caused by the platen roller and image formation by the thermal line head are controlled on a basis of a result of sheet detection performed by an optical sensor (sheet detection sensor) provided in the housing. A plurality of ribs are provided on an upper surface of the guide member in order to provide smooth sheet conveyance with reducing frictional resistance which may be generated between the sheet and the guide member.

SUMMARY

With the employment of the optical sensor, inaccurate or erroneous sheet detection may occur, if external light is incident on the optical sensor through the opening. Such external light may affect detection by the optical sensor. In order to avoid this problem, a light shielding member may be provided at a position closer to the opening than the optical sensor to the opening. Here, the plurality of ribs provides a concavo-convex profile at the guide member. Therefore, even if a lower end of the light shielding member is in contact with the guide member in an attempt to shut off external light, a minute gap still exists between the upper surface of the guide member and the lower end of the light shielding member due to the concavo-convex profile. Accordingly, still another countermeasure should be provided in order to ensure detection accuracy of the optical sensor, if the portable printer is exposed to intense light, for example, used outdoors.

It is therefore an object of the embodiment to provide a portable printer capable of ensuring detection accuracy of the optical sensor yet facilitating sheet conveyance by the plurality of ribs.

In order to attain the above and other objects, the disclosure provides a printer includes: a casing, a platen roller, a thermal line head, a guide member, an optical sensor, a controller, and a light shielding member. The casing is formed with an opening. The platen roller is provided in the casing and is configured to convey a sheet. The platen roller has an axis extending in an axial direction. The thermal line head is provided in the casing at a position in confrontation with the platen roller to provide a confronting portion between the thermal line head and the platen roller. The guide member is provided in the casing and provides an inlet passage that guides the sheet inserted through the opening toward the confronting portion. The guide member has a surface that faces the inlet passage, and includes: a plurality of ribs, and a flat surface portion. The plurality of ribs protrudes from the surface toward the inlet passage and is spaced away from each other at a predetermined interval in the axial direction. The plurality of ribs is configured to contact the sheet in the inlet passage to guide the sheet. The flat surface portion faces the inlet passage and is positioned at a portion other than the plurality of ribs. The optical sensor is provided in the casing at a position in confrontation with the inlet passage. The optical sensor is configured to optically detect the sheet inserted through the opening and guided by the guide member. The controller is configured to control the platen roller and the thermal line head based on a result of sheet detection by the optical sensor. The light shielding member is provided in the casing and protrudes toward the inlet passage at a position closer to the opening than the optical sensor to the opening. The light shielding member has a protruding end in intimate contact with the flat surface portion.

BRIEF DESCRIPTION OF THE DRAWINGS

The particular features and advantages of the disclosure will become apparent from the following description taken in connection with the accompanying drawings, in which.

DETAILED DESCRIPTION

A printer 1 according to one embodiment will be described while referring to the accompanying drawings.

[Outer Configuration]

Figure 1:
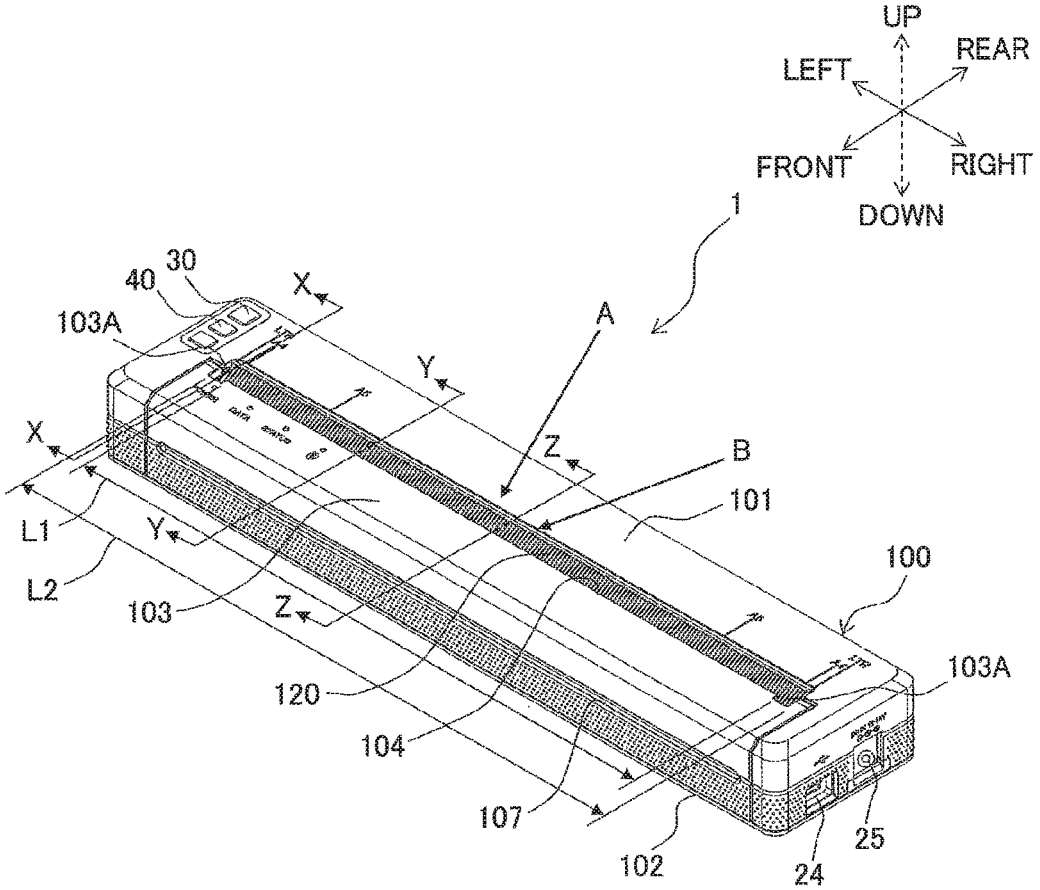
FIG. 1 is a perspective view of a printer according to one embodiment.

An outer configuration of the printer 1 will be described with reference to FIGS. 1 and 2. Throughout the specification, a left lower side in FIG. 1 will be referred to as front side, a right upper side in FIG. 1 will be referred to as rear side, a left upper side will be referred to as left side, and right lower side will be referred to as right side.

The printer 1 is adapted to print an image on a sheet S (see FIG. 3A) on a basis of print data received from an external device 2 (see FIG. 4) such as a personal computer and a cellular telephone through wire communication, wireless communication or infrared communication. A heat-sensitive paper is an example of the sheet S. The printer 1 is operable with a power source such as a battery unit 10 (see FIG. 4) that incorporates a rechargeable battery, so that the printer 1 is portable and used at various locations.

The printer 1 includes a housing 100 (as an example of a casing) having a shape of rectangular parallelepiped constituting a shell or an outer frame and made from a resin. The housing 100 includes a top cover 101 (as an example of a first cover) constituting an upper portion of the outer frame, a lower cover 102 (as an example of a second cover) constituting a lower portion of the outer frame, and a cover member 103 (as an example of an opening/closing cover) pivotally movably supported to a front end portion of an upper surface of the top cover 101. An insertion opening 104 (as an example of an opening) extending in the leftward/rightward direction is formed between the top cover 101 and the cover member 103. In other words, the insertion opening 104 is formed at an upper surface of the housing 100 so that the sheet S can be inserted through the insertion opening 104. Further, a discharge opening 107 extending in the leftward/rightward direction is formed between the cover member 103 and the lower cover 102. In other words, the discharge opening 107 is formed at a front side of the housing 100 so that the printed sheet S can be discharged outside through the discharge opening 107.

[Internal Configuration]

An internal configuration of the printer 1 will be described with reference to FIGS. 2, 3A and 3B.

A platen roller 111 and a thermal line head 112 are provided in an interior of the housing 100. The platen roller 111 extends in the leftward/rightward direction, and is supported by a pair of side chassis 130L, 130R (FIG. 2) provided in the housing 100 such that the platen roller 111 is in confrontation with the thermal line head 112 in the upward/downward direction. The platen roller 111 is covered by the cover member 103. A drive motor 11 (FIG. 4) is provided for rotationally driving the platen roller 111 for conveying the sheet S. The thermal line head 112 is provided on a heatsink 114. The heatsink 114 has each end face in the leftward/rightward direction, and a shaft 113 extends outward from a rear end portion of each end face. Each of the shafts 113 is rotatably supported to each of the side chassis 130L and 130R, so that the heatsink 114 is supported to the side chassis 130L, 130R and pivotally movable about an axis of the shaft 113 relative to the side chassis 130L, 130R. A main chassis 150 is provided on an inner surface of the lower cover 102. The main chassis 150 is provided with a plurality of coil springs 115 (FIGS. 3A and 3B) for urging the heatsink 114 toward the platen roller 111. Thus, the thermal line head 112 can be urged toward the platen roller 111, so that the sheet S passing through a boundary between the thermal line head 112 and platen roller 111 can be printed while a predetermined force is applied from the thermal line head 112 toward the platen roller 111. A guide member 120 (described later) is provided at a position below the insertion opening 104 for directing the sheet S toward a confronting portion P (pressure contact portion, see FIG. 3A) between the platen roller 111 and the thermal line head 112. During printing, in a state where the cover member 103 is closed, the sheet S inserted through the insertion opening 104 is conveyed to the confronting portion P by the platen roller 111 while being guided by the guide member 120, so that printing is performed by the thermal line head 112.

The housing 100 has a rear side formed with an attachment/detachment recess 410 to which one of the battery unit 10 and an installable adapter DA having a shape and dimension the same as those of the battery unit 10 is selectively attachable. Incidentally, in FIGS. 2, 3A, and 3B, the installable adapter DA is attached to the attachment/detachment recess 410. The attachment/detachment recess 410 is exposed to an outside at a rear side of the housing 100 in a state where neither the battery unit 10 nor the installable adapter DA is attached.

[Fixing Structure of Guide Member]

Fixing structure of the guide member 120 will next be described. In the following description, the frontward/rearward direction, the leftward/rightward direction, and the upward/downward direction are the directions in a state where the guide member 120 and other components are assembled together.

Figure 2:
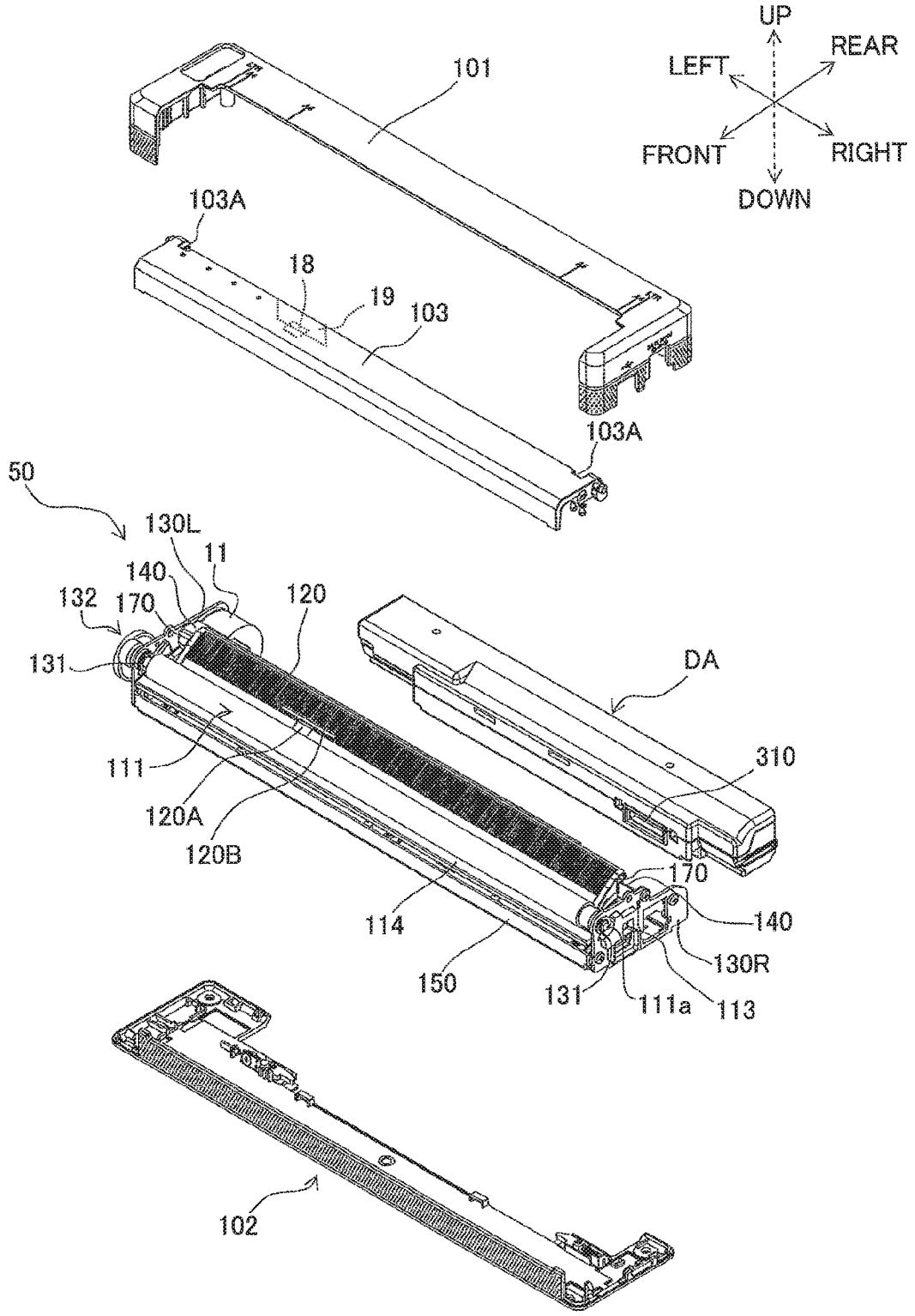
FIG. 2 is an exploded perspective view of the printer illustrating internal construction thereof.

As illustrated in FIG. 2, the printer 1 includes the housing 100 and a chassis assembly 50. The housing 100 includes the top cover 101, the lower cover 102, and the cover member 103. The chassis assembly 50 includes the main chassis 150 provided at the inner surface of the lower cover 102 and constituting a bottom portion of the chassis assembly 50, and the pair of side chassis 130L and 130R. Each side chassis 130L, 130R upstands from each longitudinal end portion of the main chassis 150. Each of the side chassis 130L, 130R is formed with a hole 131 through which a platen roller shaft 111*a* of the platen roller 111 extends. The platen roller shaft 111*a* of the platen roller 111 defines an axial direction of the platen roller 111. Thus, each end portion in the leftward/rightward direction of the platen roller 111 is rotatably supported by each of the side chassis 130L, 130R. Further, as described above, each of the side chassis 130L, 130R pivotally movably supports the heatsink 114 provided with the thermal line head 112 through the shaft 113.

The drive motor 11 and a gear mechanism 132 are provided at the left side chassis 130L. The gear mechanism 132 includes a plurality of gears and is adapted to transmit driving force of the drive motor 11 to the platen roller shaft 111*a* of the platen roller 111.

A beam member 140 is spanned between upper portions of the side chassis 130L and 130R, and is fixed thereto by threads. The guide member 120 is prepared separately from the top cover 101, the lower cover 102 and the cover member 103 those constituting the housing 100. The guide member 120 is fixed to the beam member 140 so that the guide member 120 is supported to the side chassis 130L, 130R. Incidentally, the beam member 140, the main chassis 150 and the side chassis 130L, 130R are examples of a frame.

In the above-described embodiment, the housing 100 and its internal components and structure are examples of a printer body. That is a portion other than the battery unit 10 or the installable adapter DA is the example of the printer body, and a combination of the printer body and one of the battery unit 10 and the installable adapter DA is an example of a printer.

[Control System]

Next a control system in the printer 1 will be described with reference to FIG. 4.

The printer 1 includes a CPU 12 (as an example of a controller). A ROM 14 and an SDRAM 13 are connected to the CPU 12. The CPU 12 is adapted to perform signal processing in accordance with a program stored in the ROM 14 using temporary storage function of the SDRAM 13 in order to entirely control the printer 1.

The CPU 12 is electrically connected to the battery unit 10 in response to the attachment of the battery unit 10. Further, the CPU 12 is also connected to a power circuit 15 adapted to perform ON/OFF processing, a motor driver circuit 16 adapted to control the drive motor 11 that drives the platen roller 111, and a thermal line head control circuit 17 adapted to control the thermal line head 112. Incidentally, as illustrated in FIG. 1, the printer 1 has a DC jack 25 electrically connectable to a DC plug (not shown) of an external power supply device such as an AC adapter. The DC jack 25 is connected to the power circuit 15. When the DC plug is connected to the DC jack 25, electrical power supply from the external power supply device to the printer 1, more specifically, to the power circuit 15, the motor driver circuit 16, and the thermal line head control circuit 17 can be achieved instead of the power supply from the battery unit 10.

A feed key 40 for sheet feed operation and a power source key 30 for ON/OFF operation to the power supply are provided at the housing 100, and these keys are connected to the CPU 12. The CPU 12 will execute processing in accordance with pressing operation of one of the keys. That is, when the feed key 40 is depressed, the CPU 12 outputs control signal to the motor driver circuit 16 to energize the drive motor 11 to rotate the platen roller 111 in order to feed the sheet S by a predetermined length. When the power source key 30 is depressed while the printer 1 is rendered OFF, the CPU 12 outputs control signal to the power circuit 15 to perform power ON operation. When the power source key 30 is depressed while the printer 1 is rendered ON, the CPU 12 outputs control signal to the power circuit 15 to perform power OFF operation.

The CPU 12 is also connected to a USB interface driver circuit 21, a wireless communication portion 22, and an infrared communication portion 23. A USB terminal 24 (FIG. 1) is provided at the housing 100. The USB interface driver circuit 21 is adapted to control communication to the external device 2 through a USB cable (not shown) connected to the USB terminal 24. The wireless communication portion 22 is adapted to control wireless communication to the external device 2 via radio wave other than infrared ray. The infrared communication portion 23 is adapted to control infrared communication to the external device 2.

For printing operation with the above-described structure, an operator (user) inputs print data for printing the sheet S using the external device 2 such as the personal computer and the cellular telephone, and performs input operation for instructing initiation of printing. Thus, print data is transmitted from the external device 2 to the printer 1 through the USB cable (or through wireless communication or infrared communication), and printing operation based on the print data will be performed in the printer 1.

[First Feature: Installable Adapter]

One of the features of the depicted embodiment resides in installation of the installable adapter DA to the attachment/detachment recess 410 instead of the battery unit 10 when power supply from the external power supply device is desired. With this structure, the printer 1 can be easily attached to an object DB such as an in-car fixed plate and a dashboard. The installation of the installable adapter DA will be described below in detail.

[Installation to the Recess and Detachment from the Recess]

Figure 5A:
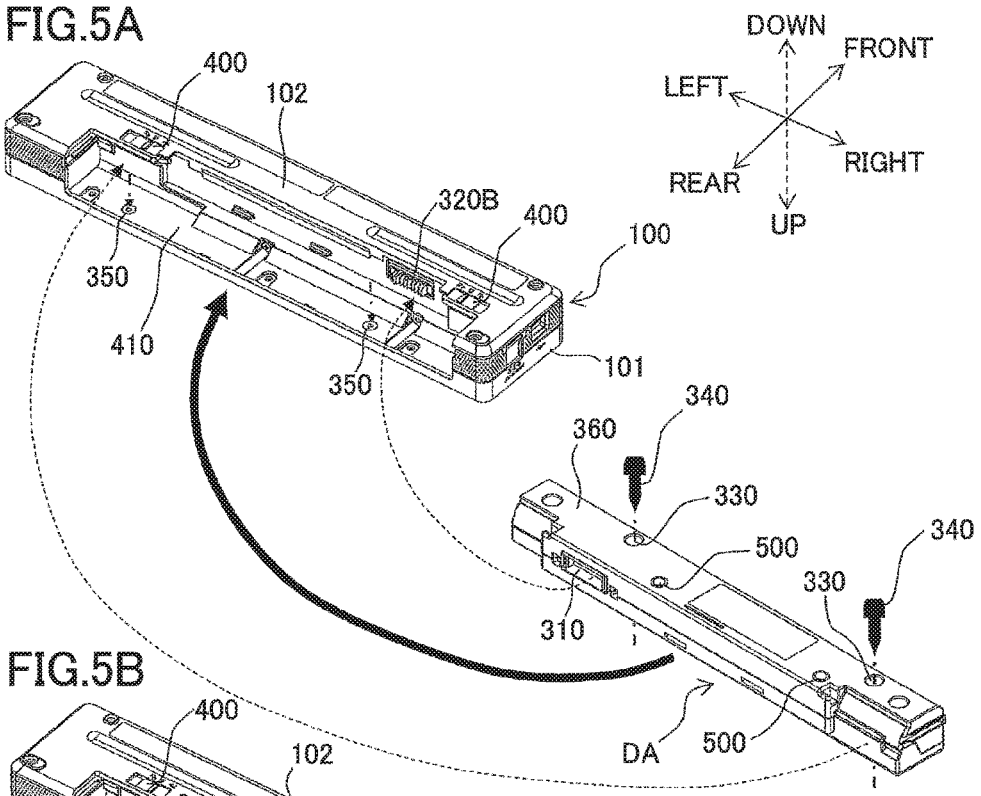
FIG. 5A is a view for description of behavior of an adapter to be attached to a recessed portion of the printer.
Figure 5B:
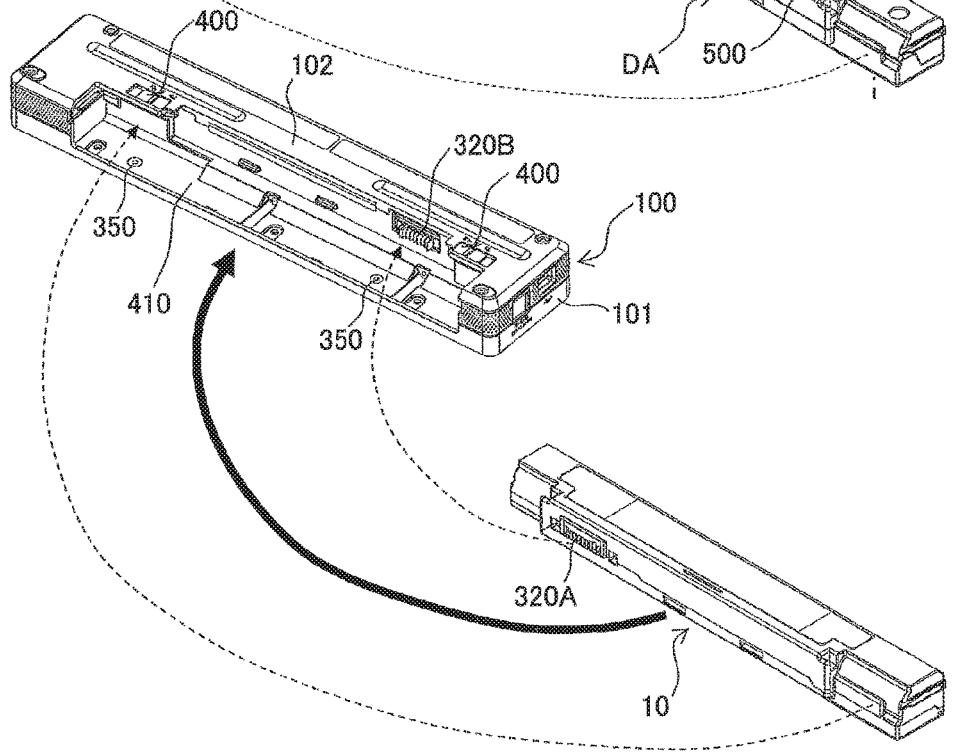
FIG. 5B is a view for description of behavior of a battery unit to be attached to the recessed portion of the printer.

As illustrated in FIGS. 5A and 5B, the attachment/detachment recess 410 is provided at a position ranging from a rear end portion of the lower cover 102 to a rear end portion of the top cover 101 in the housing 100. One of the battery unit 10 and the installable adapter DA can be selectively attached to the attachment/detachment recess 410. FIG. 5A illustrates attachment of the installable adapter DA to the attachment/detachment recess 410, and FIG. 5B illustrates attachment of the battery unit 10 to the attachment/detachment recess 410.

A slide hook 400 is provided at each end portion of the lower cover 102 in the leftward/rightward direction to engage the battery unit 10 or the installable adapter DA attached to the attachment/detachment recess 410. Each slide hook 400 has a base portion provided with a spring. For the attachment of the battery unit 10 (or the installable adapter DA) to the attachment/detachment recess 410, the battery unit 10 (or the installable adapter DA) is pushed into the attachment/detachment recess 410, so that the slide hooks 400 are slidingly moved away from each other in the leftward/rightward direction against biasing force of the springs. The slide hooks 400 are then slidably moved toward each other to provide an engagement state when the battery unit 10 (or the installable adapter DA) is completely installed into the attachment/detachment recess 410. On the other hand, the engagement is released by slidingly moving the slide hooks 400 in the direction away from each other. Thus, takeoff the battery unit 10 (or the installable adapter DA) from the attachment/detachment recess 410 can be realized.

As illustrated in FIG. 5B, a first connector 320A is provided at a left portion of a rear surface of the battery unit 10. Here, the terms "rear" and "left" are used in a state prior to the attachment. Further, a second connector 320B corresponding to the first connector 320A is provided at a rear wall of the attachment/detachment recess 410 that faces rearward. The second connector 320B of the attachment/detachment recess 410 is electrically connected to the first connector 320A of the battery unit 10 upon attachment of the battery unit 10 to the attachment/detachment recess 410, so that electrical power from the battery unit 10 can be supplied to the printer 1, more specifically, to the power circuit 15, the motor driver circuit 16, and the thermal line head control circuit 17.

Figure 6:
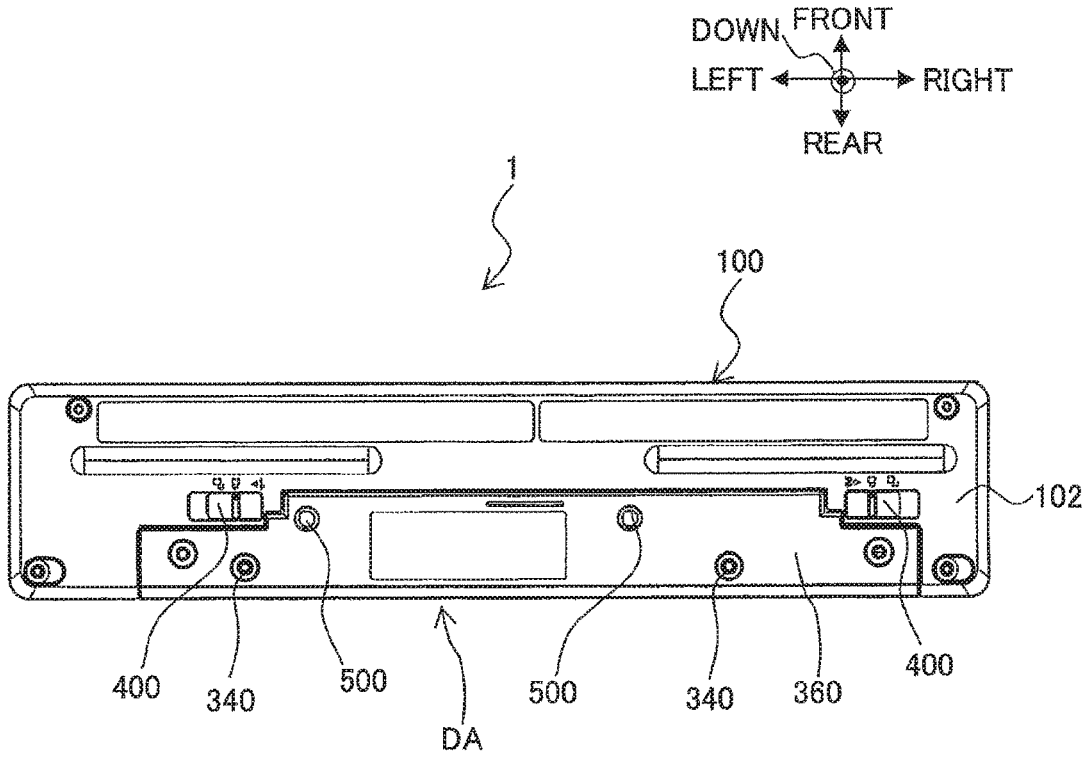
FIG. 6 is a bottom view of the printer to which the adapter is attached.

The installable adapter DA has an outer shape approximately the same as that of the battery unit 10. As illustrated in FIG. 5A, a connector accommodating portion 310 having a generally rectangular open end is provided instead of the first connector 320A of the battery unit 10 at a left portion of a rear surface of the installable adapter DA. The second connector 320B of the attachment/detachment recess 410 is accommodated in the connector accommodating portion 310 of the installable adapter DA upon attachment of the installable adapter DA to the attachment/detachment recess 410. As illustrated in FIG. 6, an attachment surface of the housing 100 with respect to the object DB (FIGS. 7A and 7B), that is a bottom surface of the lower cover 102 is flush with an attachment surface 360 of the installable adapter DA, that is a bottom surface of the installable adapter DA upon completion of attachment of the installable adapter DA to the housing 1000. Accordingly, the printer 1 in its entirety has a generally rectangular parallelepiped shape. The same is true with respect to the attachment of the battery unit 10 to the housing 100.

As illustrated in FIG. 5A, a pair of insertion holes 330 spaced away from each other in the leftward/rightward direction is open at the attachment surface 360. Further, a pair of fastening portions 350 aligned with the pair of insertion holes 330 is open at a lower surface of a top wall portion of the top cover 101 constituting the attachment/detachment recess 410. A pair of fixing bolts 340 is inserted through the pair of insertion holes 330, and is threadingly engaged with the pair of fastening portions 350. Thus, the installable adapter DA can be fixed to the attachment/detachment recess 410.

Figure 7A:
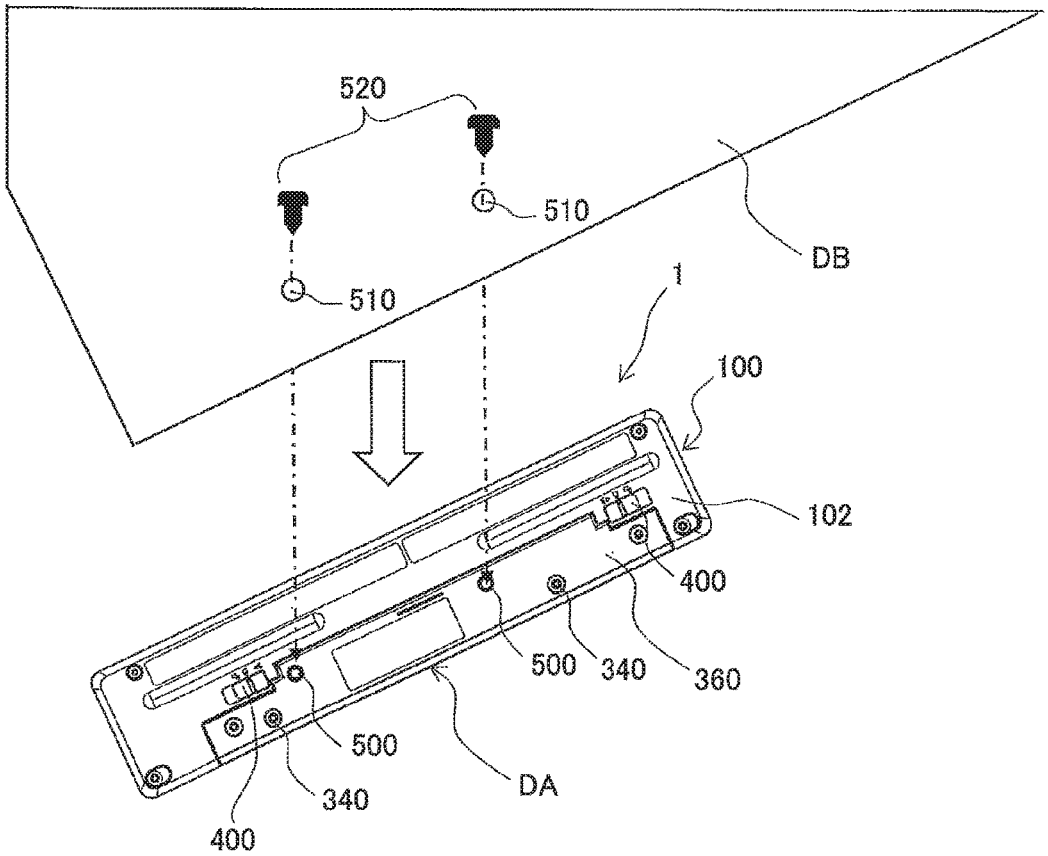
FIG. 7A is a view for description of attachment of the printer to an object.
Figure 7B:
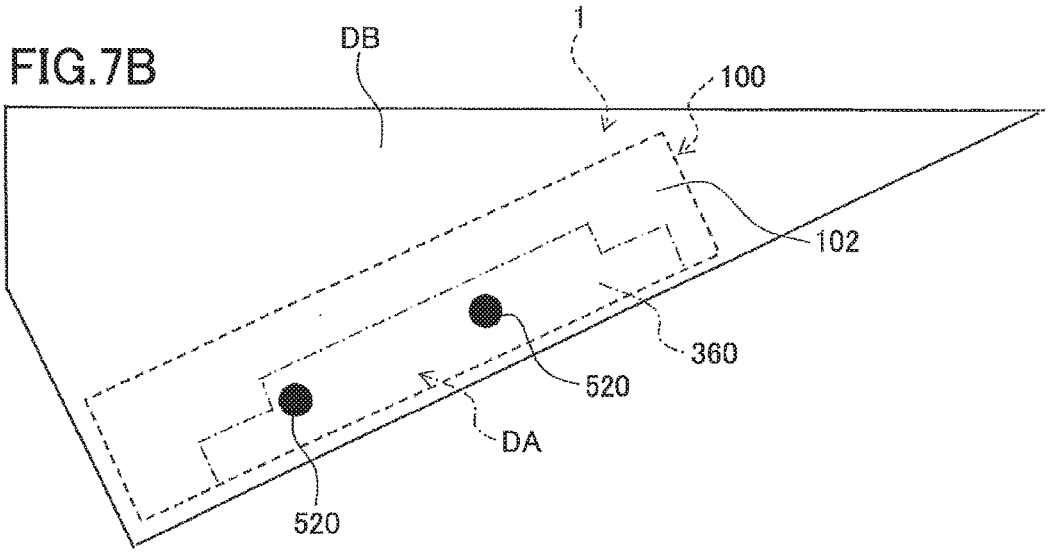
FIG. 7B is a view illustrating a rear side of the article to which the printer has been attached.

Further, as illustrated in FIG. 7A, a pair of attachment portions 500 spaced away from each other in the leftward/rightward direction is open at the attachment surface 360 of the installable adapter DA. The object DB is formed with a pair of insertion holes 510 corresponding to the pair of attachment portions 500. Each of the insertion holes 510 permits a fixing bolt 520 to pass therethrough. A predetermined portion of a vehicle such as an automobile and a service vehicle, and a portion of a building would be the object DB. Incidentally, FIGS. 7A and 7B are illustrated when viewed from a back side of the object DB. FIGS. 7A and 7B illustrate a fixing plate to be fixed to the dashboard. The fixing plate is an example of the object DB. For attaching the printer 1 to the object DB, the pair of attachment portions 500 is aligned with the pair of insertion holes 510, and then, the pair of fixing bolts 520 is inserted into the pair of insertion holes 510 from the back side of object DB, and the fixing bolts 520 are threadingly engaged with the attachment portions 500 as illustrated in FIG. 7A. Thus, the printer 1 provided with the installable adapter DA can be fixed to the object DB.

[Second Feature: Light Shielding Member]

A second feature of the embodiment resides in light shielding against an optical sensor 18.

As described with reference to FIG. 3A, the sheet S is inserted into the interior of the housing 100 through the insertion opening 104, and then the sheet S is fed to the confronting portion P between the platen roller 111 and the thermal line head 112 through an inlet passage RT defined by the guide member 120. The inlet passage RT is the passage along which the sheet S is fed as indicated by two dotted chain line in FIG. 3A. Then, the thermal line head 112 prints an image on the sheet S conveyed by the platen roller 111.

The optical sensor 18 is provided at an internal portion of the housing 100 facing the inlet passage RT. More specifically, the optical sensor 18 is provided at a lower surface of the cover member 103. The optical sensor 18 is configured to optically detect the sheet S guided by the guide member 120. A conventional reflection type sensor or a transmission type sensor is available as the optical sensor 18 for detecting existence or non-existence of the sheet S or a mark formed on the sheet S. In accordance with the control by the CPU 12 based on the detection result by the optical sensor 18, sheet conveyance by the platen roller 111 and the printing by the thermal line head 112 are performed. Incidentally, the optical sensor 18 can be provided at the guide member 120.

Figure 3A:
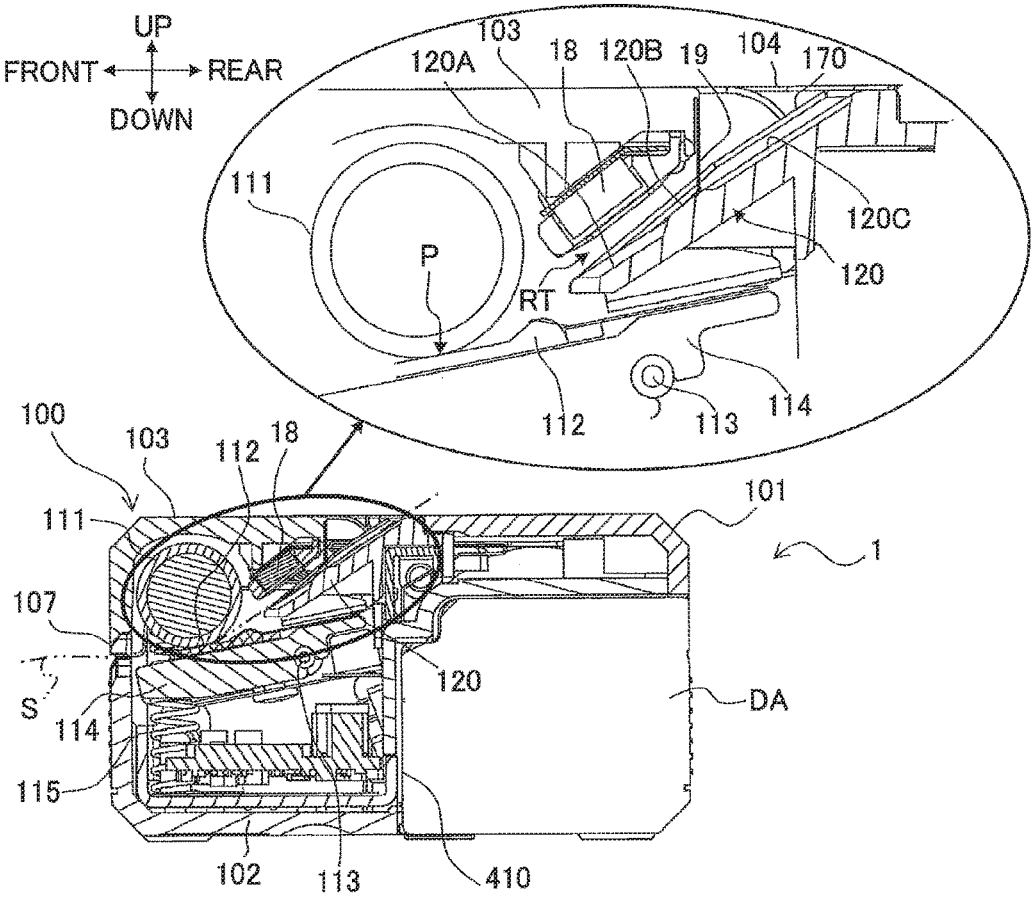
FIG. 3A is a cross-sectional view taken along a line Y-Y in FIG. 1.
Figure 3B:
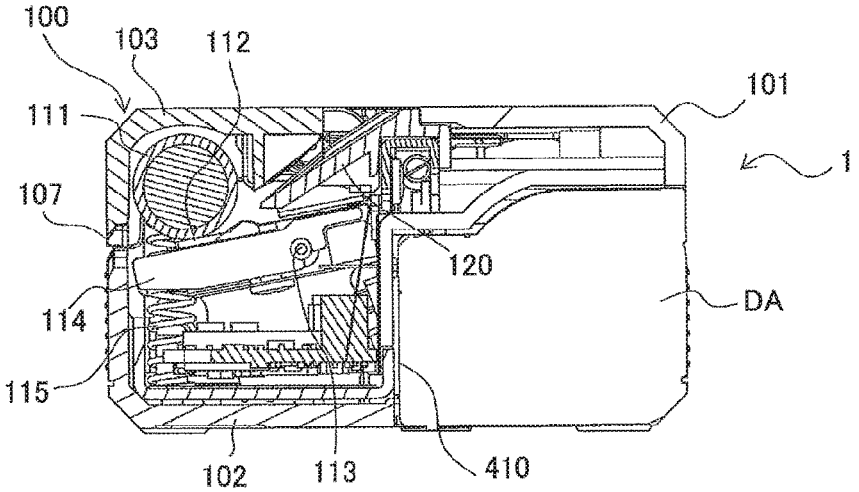
FIG. 3B is a cross-sectional view taken along a line Z-Z in FIG. 1.

As illustrated in FIGS. 2, 3A and 3B, a light shielding member 19 is provided in the interior of the housing 100, that is, the light shielding member 19 is provided at the cover member 103 at a position closer to the insertion opening 104 than the optical sensor 18 to the insertion opening 104. The light shielding member 19 is in a form of a curtain or a flexible plate. The light shielding member 19 is adapted to shut off light incident through the insertion opening 104 to prevent light from reaching the optical sensor 18 in order to avoid malfunction or erroneous detection by the optical sensor 18.

Figures 8A, 8B:
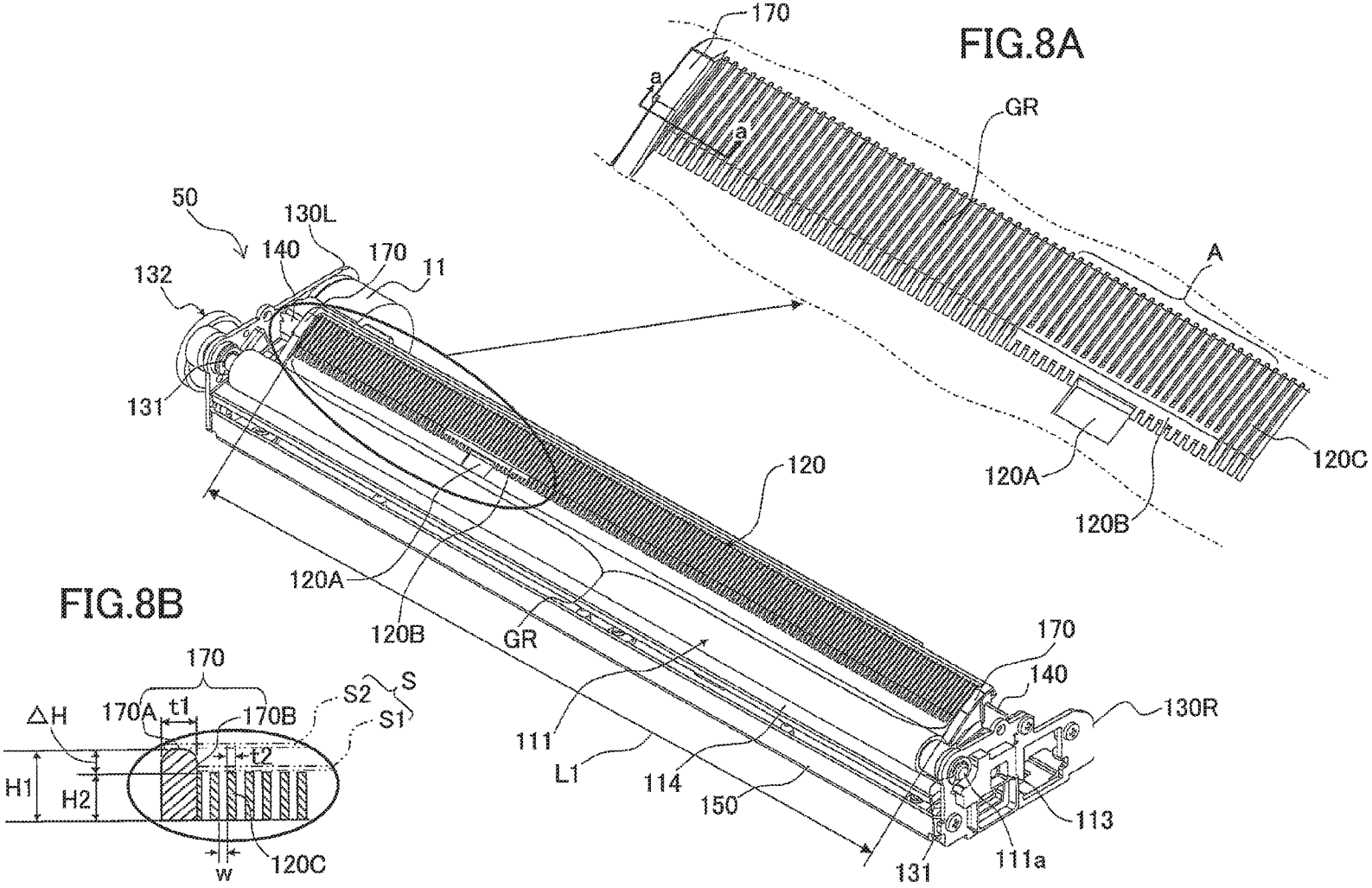
FIG. 8A is a perspective view of the printer in which a guide member, a platen roller, and a heatsink are attached to a frame including a beam, a main chassis, and a pair of side chassis.
FIG. 8B is a cross-sectional view taken along a line a-a of FIG. 8A.

As illustrated in FIG. 8A, a plurality of ribs 120C is provided at an upper surface of the guide member 120. These ribs are in contact with the sheet S and guide the sheet S while reducing frictional resistance relative to the sheet S to realize smooth sheet conveyance. These ribs 120C protrude toward the inlet passage RT and are arrayed with a predetermined interval "w" between neighboring ribs in the leftward/rightward direction as illustrated in FIG. 8B.

Here, the plurality of ribs 120C provides concavity and convexity at the surface of the guide member 120 exposing to the inlet passage RT, that is, on the upper surface of the guide member 120. As a result, in a case where the light shielding member 19 protruding toward the inlet passage RT is in contact with the upper surface of the guide member 120, a minute gap is provided at a position between a tip end of the light shielding member 19 (lower end of the light shielding member 19) and the upper surface of the guide member 120. Accordingly, if such a printer is used outdoors under exposure to intense outside light, a countermeasure is necessary to ensure detection accuracy of the optical sensor 18 against external light.

To this effect, according to the present embodiment, as illustrated in FIGS. 2, 3A and 8A, a flat surface portion 120B is provided at the upper surface of the guide member 120 at a position other than the plurality of ribs 120C. The free end portion (protruding end or lower end portion) of the light shielding member 19 is in abutment with and in intimate contact with the flat surface portion 120B while the light shielding member 19 is slackened or flexed.

Figure 9A:
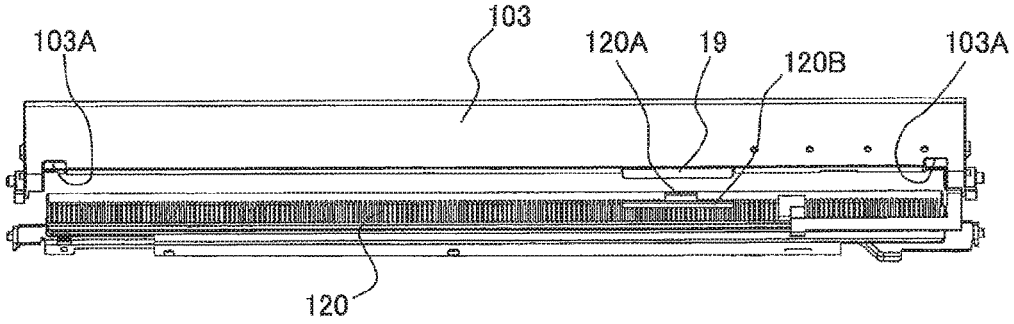
FIG. 9A is a view as viewed in a direction A in FIG. 1.
Figure 9B:
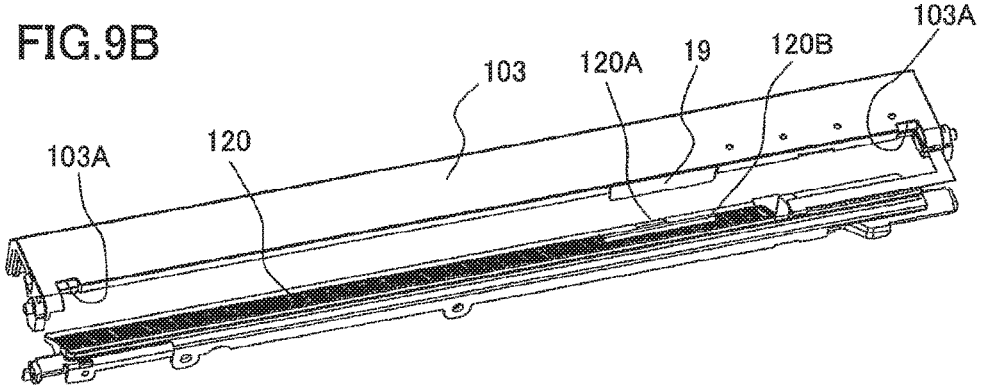
FIG. 9B is a view as viewed in a direction B in FIG. 1.
Figure 9C:
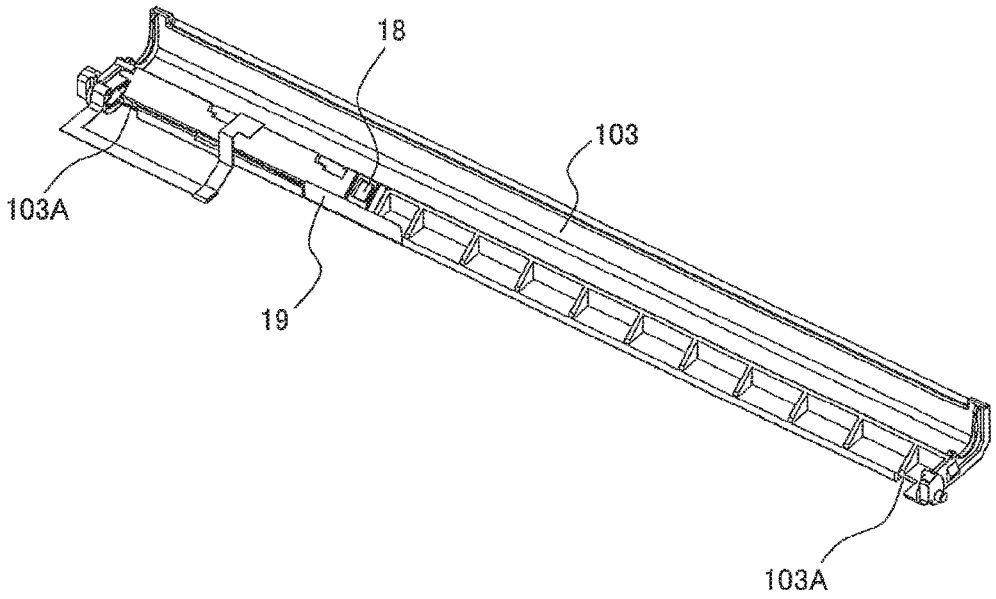
FIG. 9C is a perspective view of a cover as viewed from its bottom.

More specifically, as illustrated in FIGS. 3A and 9C, the optical sensor 18 is provided at the wall surface of the cover member 103 (lower surface of the cover member 103) facing the inlet passage RT. The light shielding member 19 is provided at the wall surface of the cover member 103 at a position closer to the insertion opening 104 than the optical sensor 18 to the insertion opening 104, so that the lower end portion of the light shielding member 19 is in contact with the flat surface portion 120B in closing state of the cover member 103. In this way, since the end portion of the light shielding member 19 is not in contact with the concavity and convexity portion but in contact with the flat surface, light entry through the above-described gap can be prevented.

As illustrated in FIGS. 3A, 8A, 9A, and 9B, a recessed portion 120A is formed on the upper surface of the guide member 120, the upper surface being facing the inlet passage RT at a position in confrontation with the optical sensor 18. The flat surface portion 120B is positioned closer to the insertion opening 104 than the recessed portion 120A to the insertion opening 104.

As illustrated in FIG. 3A, protruding end faces (upper end faces) of the plurality of ribs 120C are substantially flush with the flat surface portion 120B. Further, the ribs 120C as indicated by "A" in FIG. 8A those positioned upstream of the flat surface portion 120B in the sheet conveying direction have upper surfaces continuous with an upstream end of the flat surface portion 120B in the sheet conveying direction. Further, as illustrated in FIG. 8B, the interval "w" between neighboring ribs 120C is approximately the same as a thickness "t2" of each rib 120C in the arraying direction.

[Third Feature: Guide Rib Portion]

Still another feature of the embodiment resides in guide rib portions for guiding widthwise edges of the sheet S, the widthwise edges extending in the sheet conveying direction.

As illustrated in FIG. 8A, the plurality of ribs 120C provides a rib region having a length L1 in the leftward/rightward direction. The region functions as a guide region GR configured to guide the sheet S introduced into the inlet passage RT while the lower surface of the sheet S is in contact with the plurality of ribs 120C.

A guide rib portion 170 protruding toward the inlet passage RT (protruding upward) is provided at each end of the guide region GR in the leftward/rightward direction. Incidentally, FIG. 1 does not illustrate the guide rib portion 170 for simplicity. Each of the guide rib portions 170 faces each end portions of the insertion opening 104 in the leftward/rightward direction.

Each guide rib portion 170 has an inner surface 170B confronting with each other in the leftward/rightward direction. As illustrated in FIG. 8B, each inner surface 170B extends in the protruding direction of the guide rib portion 170, i.e., the inner surface 170B is a vertical surface. Further, each guide rib portion 170 has a rounded top end portion 170A formed into an arcuate shape protruding upward. Each guide rib portion 170 has a thickness "t1" greater than the thickness "t2" of the ribs 120C.

Figure 11A:
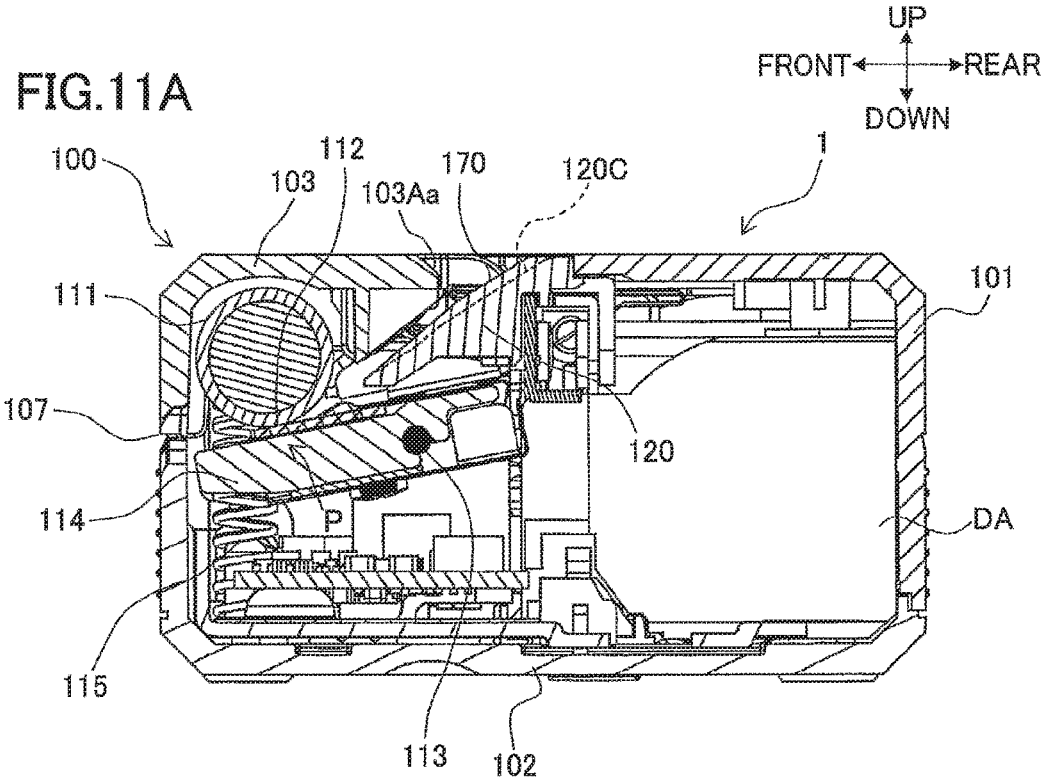
FIG. 11A is a cross-sectional view of the printer taken along a line X-X in FIG. 1, and illustrating an open state of the cover.

Each guide rib portion 170 has a protruding length (height) H1 greater than protruding length (height) H2 of the ribs 120C. Further, the guide rib portions 170 are sloped downward toward the front of the housing 100. Further, as illustrated in FIG. 11A, each guide rib portion 170 has a wedge shape in side view such that the difference in a length ΔH between the protruding length H1 of the guide rib portion 170 and the protruding length H2 of the ribs 120C is gradually reduced in the sheet conveying direction. The guide rib portions 170 and the ribs 120C have uppermost surfaces substantially flush with the upper surfaces of the top cover 101 and the cover member 103 as illustrated in FIGS. 11A and 11B.

The guide rib portions 170, 170 are spaced away from each other by the length (width) equal to the length L1 of the guide region GR in the leftward/rightward direction, and the length L1 is in conformance with a width of the sheet S which is typically used. The width of this sheet will be referred to as "typical width". In the depicted embodiment, the typical width is a width of an A4 size sheet S1. Thus, a distance between the inner surfaces 170B of the guide rib portions 170 is approximately equal to a dimension of a short side of the A4 size sheet S1. In case the A4 size sheet S1 is to be used, the user allows each widthwise edge of the A4 size sheet S1 to be abutted on each guide rib portion 170. Thus, the A4 size sheet S1 can be smoothly set to a correct position in the inlet passage RT.

Figure 10:
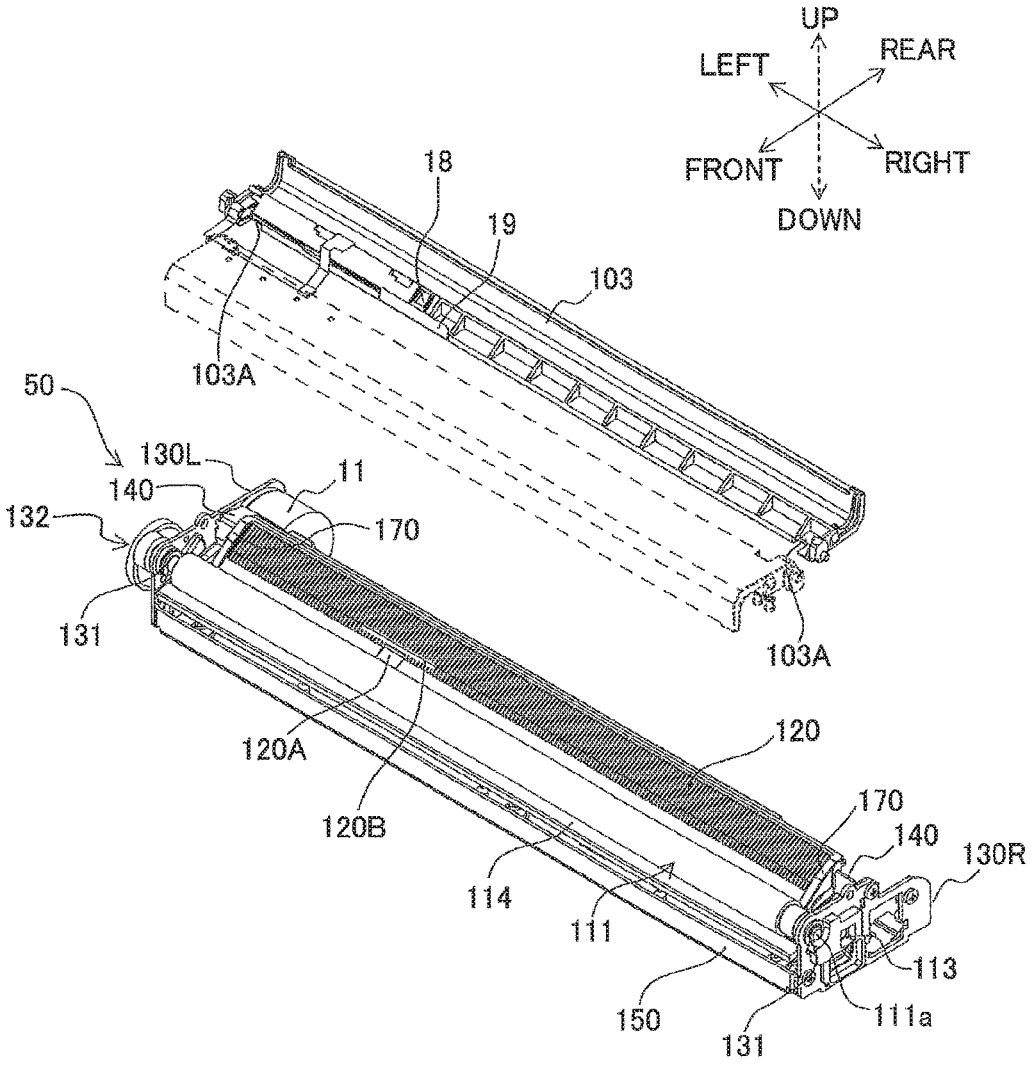
FIG. 10 is an exploded perspective view illustrating an open state of the cover.
Figure 11B:
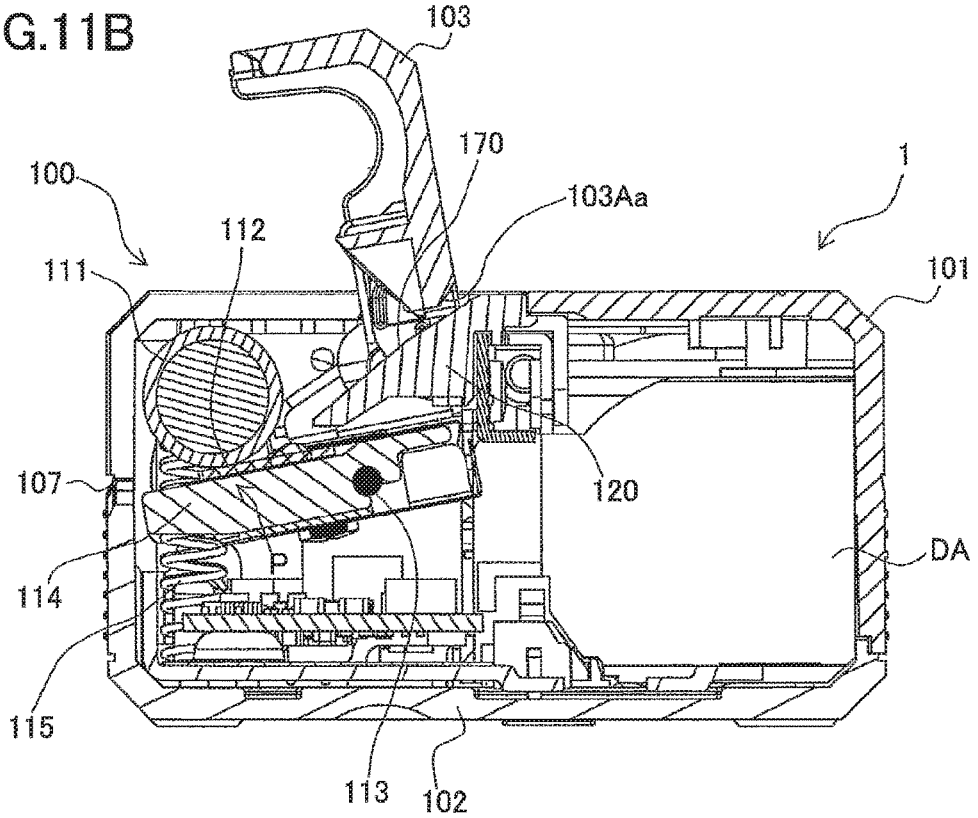
FIG. 11B is a cross-sectional view of the printer taken along a line X-X in FIG. 1, and illustrating a closed state of the cover.

As illustrated in FIGS. 1, 2, and 8A through 11B, the cover member 103 is formed with a pair of recesses 103A. Each recess 103A is recessed frontward and positioned frontward of and in alignment with each guide rib portion 170. As best shown in FIGS. 11A and 11B, each recess 103A has a sloped surface 103Aa sloped downward in the rearward direction. Here, a distance between a right side edge of the left recess 103A and a left side edge of the right recess 103A is equal to the above described length "L1". On the other hand, a distance between a left side edge of the left recess 103A and a right side edge of the right recess 103A has a length "L2" which is greater than the length "L1", and is approximately equal to a width of a letter size sheet S2. If a sheet having a width greater than the typical width of the A4 size sheet S1 is exceptionally used, for example, the letter size sheet S2 is used, the letter size sheet S2 is set such that the widthwise edges of the letter size sheet S2 are in contact with the left side edge of the left recess 103A and the right side edge of the right recess 103A, with climbing over the two guide rib portions 170.

Further, the two recesses 103A provide the benefits as follows.

That is, as described above, for printing operation, the sheet S inserted through the insertion opening 104 by a user is conveyed by the platen roller 111 while being guided by the guide member 120, and then printing is performed by the thermal line head 112 on the sheet S.

In this case, if sheet jamming occurs, the user moves the cover member 103 from its closed position illustrated in FIG. 11A to its open position illustrated in FIG. 11B. Thus, the thermal line head 112 can be moved downward to release pressure contact between the platen roller 111 and the thermal line head 112 for releasing the sheet S. Thus, the sheet S can be easily pulled out.

Here, if the recesses 103A were not formed on the cover member 103, mechanical interference may occur between the cover member 103 and the protruding guide rib portions 170 during opening movement of the cover member 103. These recesses 103A are formed to avoid such mechanical interference. As illustrated in FIGS. 10 and 11B, the guide rib portions 170 are partly entered into the recesses 103A, thereby avoiding the mechanical interference. Incidentally, in FIG. 10 the cover member 103 is illustrated upside down in order to clarify the positional relationship between the recesses 103A and the guide rib portions 170 in the open state of the cover member 103. The cover member 103 is not necessarily be pivotally moved to its upside down posture, but the cover member 103 can only be pivotally moved by an amount allowing the sheet S to be released from the platen roller 111 and the thermal line head 112, for example, by an amount illustrated in FIG. 11B.

Incidentally, in the above-described embodiment, the guide rib portion 170 is provided at each end in the leftward/rightward direction of the guide region GR, and the recess 103A is positioned to face each guide rib portion 170 at each end of the insertion opening 104. However, one of the left and right guide rib portions 170 can be dispensed with, and corresponding one of the recesses 103A can also be dispensed with as long as the sheet S can be accurately conveyed along the single guide rib portion 170.

[Effect in the Embodiment]

As described above, the printer 1 is battery powered. That is, the platen roller 111 and the thermal line head 112 those provided in the housing 100 are driven by electric power supplied from the battery unit 10 for performing printing on the sheet S. In this case, the battery unit 10 can be attached to and detached from the attachment/detachment recess 410 of the housing 100.

On the other hand, the printer 1 can be attached to a suitable object DB by using the installable adapter DA prepared separately. The installable adapter DA has the outer shape approximately the same as that of the battery unit 10. For attaching the printer 1 to the object DB, the battery unit 10 is detached from the attachment/detachment recess 410, and instead, the installable adapter DA is attached to the attachment/detachment recess 410. In this case, the printer 1 can be easily attached to the object DB, since the installable adapter DA is provided with the pair of attachment portions 500 for attaching the printer 1 to the object DB.

In this way, the printer 1 can be easily attached to the object DB with making use of the battery accommodation space by attaching the installable adapter DA to the printer body after detaching the battery unit 10 from the printer body. This arrangement enhances user's convenience.

Further, according to the depicted embodiment, the attachment surface of the housing 100 relative to the object DB and the attachment surface 360 of the installable adapter DA relative to the object DB are substantially flush with each other. With this structure, an entire attachment surface of the printer 1 provided with the installable adapter DA is substantially flat, thereby enhancing stability in the attachment to the object DB.

Further, according to the depicted embodiment, the second connector 320B of the attachment/detachment recess 410 is accommodated in the connector accommodating portion 310 of the installable adapter DA upon attachment of the installable adapter DA to the attachment/detachment recess 410. With this structure, the second connector 320B which is not used in case of the attachment of the installable adapter DA but is only used for the connection to the battery unit 10 can be positively protected by the connector accommodating portion 310 of the installable adapter DA.

Further, according to the depicted embodiment, the attachment surface 360 of the installable adapter DA is formed with the pair of insertion holes 330, and the attachment/detachment recess 410 is formed with the pair of fastening portions 350 for fixing the fixing bolts 340. In the attachment of the installable adapter DA to the attachment/detachment recess 410, after inserting the fixing bolts 340 into the insertion holes 330 of the installable adapter DA, the fixing bolts 340 are fastened to the fastening portions 350 of the attachment/detachment recess 410 for fixing. Because of fixing with the bolts, the printer 1 in its entirety can provide an increased rigidity.

Further, according to the depicted embodiment, the flat surface portion 120B is provided on the surface of the guide member 120 facing the inlet passage RT at a position other than the plurality of ribs 120C, and the protruding end portion of the light shielding member 19 is in abutment with the flat surface portion 120B. With this structure, no surface irregularity or concavity and convexity exists at the contacting portion to thus ensure intimate contact of the light shielding member 19 with the opponent member, i.e., the flat surface portion 120B. Consequently, external light entry can be completely blocked by the light shielding member 19 in spite of the provision of the plurality of ribs 120C, thereby ensuring detection accuracy of the optical sensor 18 while realizing smooth sheet transfer by the plurality of ribs 120C.

Further, according to the depicted embodiment, the protruding end faces (upper surface) of the plurality of ribs 120C are substantially flush with the flat surface portion 120B. With this structure, the sheet S conveyed along the guide ribs 120C can be smoothly moved onto the flat surface portion 120B, and smooth sheet conveyance can be performed.

Further, according to the depicted embodiment, the recessed portion 120A is positioned in confrontation with the optical sensor 18, and the upper surface of the guide member 120 facing the inlet passage RT is positioned closer to the insertion opening 104 than the recessed portion 120A to the insertion opening 104. With this structure, a space provided by the recessed portion 120A is provided at a position opposite to the optical sensor 18 with respect to the sheet S. In other words, floating state of the sheet S can be provided by the recessed portion 120A. Thus, detection accuracy can further be improved.

Further, according to the depicted embodiment, the ribs 120C in the region "A" illustrated in FIG. 8A are continuous with an inlet end of the flat surface portion 120B, the inlet end being closer to the insertion opening 104 than an outlet end of the flat surface portion 120B to the insertion opening 104. With this structure, the protruding ends of the particular ribs are smoothly connected to the flat surface portion 120B, that is the particular ribs have height equal to the height of the flat surface portion 120B. Accordingly, the sheet S that has been conveyed along the end faces of the plurality of ribs 120C can be smoothly conveyed to the flat surface portion 120B positioned downstream of the particular ribs.

Further, according to the depicted embodiment, the thickness or width "t2" of each rib 120C is approximately equal to the interval length "w" between neighboring ribs. With this structure, a multiple numbers of the ribs 120C can be densely arrayed with a small interval as illustrated in FIG. 8A. With this structure, light amount incident diagonally relative to the sheet conveying direction can be reduced on the ribs 120C, and stabilized conveying performance can be provided.

Further, according to the depicted embodiment, the guide rib portions 170 and the guide region GR are provided at the surface of the plurality of ribs 120C, and the surface is in confrontation with the inlet passage RT. The guide region GR is in contact with the lower surface of the sheet S that has been introduced through the insertion opening 104 and is moving toward the confronting portion P for guiding the sheet S. The guide rib portions 170 are provided so as to define the length of the guide region GR in the leftward/rightward direction, and face the insertion opening 104. With this structure, widthwise edges of the sheet S are in abutment with the guide rib portion 170 after insertion of the sheet S through the insertion opening 104 so as to direct a leading end of the sheet to the confronting portion P. In other words, the sheet S can be easily and smoothly positioned at an accurate position on the inlet passage RT.

Here, the pair of recesses 103A is formed in the end portion of the cover member 103, the end portion being closer to the insertion opening 104, and facing the guide rib portions 170. With this structure, if the cover member 103 is opened for removing a jammed sheet, each protruding guide rib portion 170 can be entered into each recess 103A, avoiding mechanical interference between the guide rib portions 170 and the cover member 103, thereby ensuring smooth opening and closing operation of the cover member 103.

Consequently, according to the depicted embodiment, the sheet S can be easily and accurately set to the printer 1, and the cover member 103 can be smoothly opened and closed.

Further, according to the depicted embodiment, the pair of guide rib portions 170 is provided at widthwise edges of the guide region GR. The pair of guide rib portions 170 is spaced away from each other by the distance approximately equal to the short side length of the A4 size sheet S1. With this structure, positioning of the typically used A4 size sheet S1 can be facilitated, and the A4 size sheet S1 can be easily set to the inlet passage RT by abutting widthwise edges of the sheet to the pair of guide rib portions 170. If the sheet having the width greater than that of the A4 size sheet S1 is to be printed, for example, if the letter size sheet S2 is to be printed, the pair of recesses 103A is utilized for facilitating setting of such sheet to the inlet passage RT and for directing the widthwise end portions of the sheet to be positioned onto the two guide rib portions 170.

Further, according to the depicted embodiment, each guide rib portion 170 has the inner surface 170B extending in the protruding direction and defining the boundary of the guide region GR. With this structure, widthwise edges of the sheet S, particularly the A4 size sheet S1 are guided by the inner surfaces 170B. This ensures straight-running stability of the sheet S avoiding diagonal movement of the sheet.

Further, according to the depicted embodiment, each guide rib portion 170 has the rounded top end portion 170A. With this structure, in case of the employment of the sheet having the width greater than that of the typically used sheet (A4 size sheet), such large sheet can easily be directed onto the guide rib portions 170, and can be easily and accurately set to a predetermined position.

Further, according to the depicted embodiment, each guide rib portion 170 can be entered into each recess 103A in the open state of the cover member 103. With this structure, mechanical interference between the guide rib portions 170 and the cover member 103 can be eliminated in the opening operation of the cover member 103.

Further, according to the depicted embodiment, the guide region GR includes the plurality of ribs 120C, and each rib 120C has a protruding length smaller than that of the guide rib portions 170. With this structure, frictional resistance between the guide region GR and the sheet S can be reduced, thereby enhancing conveying performance.

Further, according to the depicted embodiment, the uppermost end faces of the guide rib portions 170 and the guide member 120 are approximately flush with the upper surfaces of the top cover 101 and the cover member 103. With this structure, the guide rib portions 170 and the ribs 120C do not protrude outward from a profile of the printer 1. This improves an outer appearance of the printer 1 and seatability of the printer 1.

Further, according to the depicted embodiment, the height difference ΔH between the height of the guide rib portions 170 and the height of the plurality of ribs 120C is gradually reduced toward sheet conveying direction, so that the difference provides a generally wedge shape. With this structure, the upstream portion of each guide rib portion 170 in the sheet conveying direction provides a greater ΔH providing greater sheet guide effect, and the downstream portion of each guide rib portion 170 in the sheet conveying direction provides a smaller ΔH providing a smooth sheet movement when moving past the guide rib portion 170.

Further, according to the depicted embodiment, each guide rib portion 170 is sloped downward toward front side of the printer 1, whereas each recess 103A has the sloped surface 103Aa sloping downward toward rear side of the printer 1. That is, the sloping direction of the sloped surface 103Aa is opposite to the sloping direction of the guide rib portion 170. With this structure, as illustrated in FIG. 11B, an enlarged opening angle of the cover member 103 can be realized while avoiding mechanical interference between the cover member 103 and the guide rib portions 170.

Figure 4:
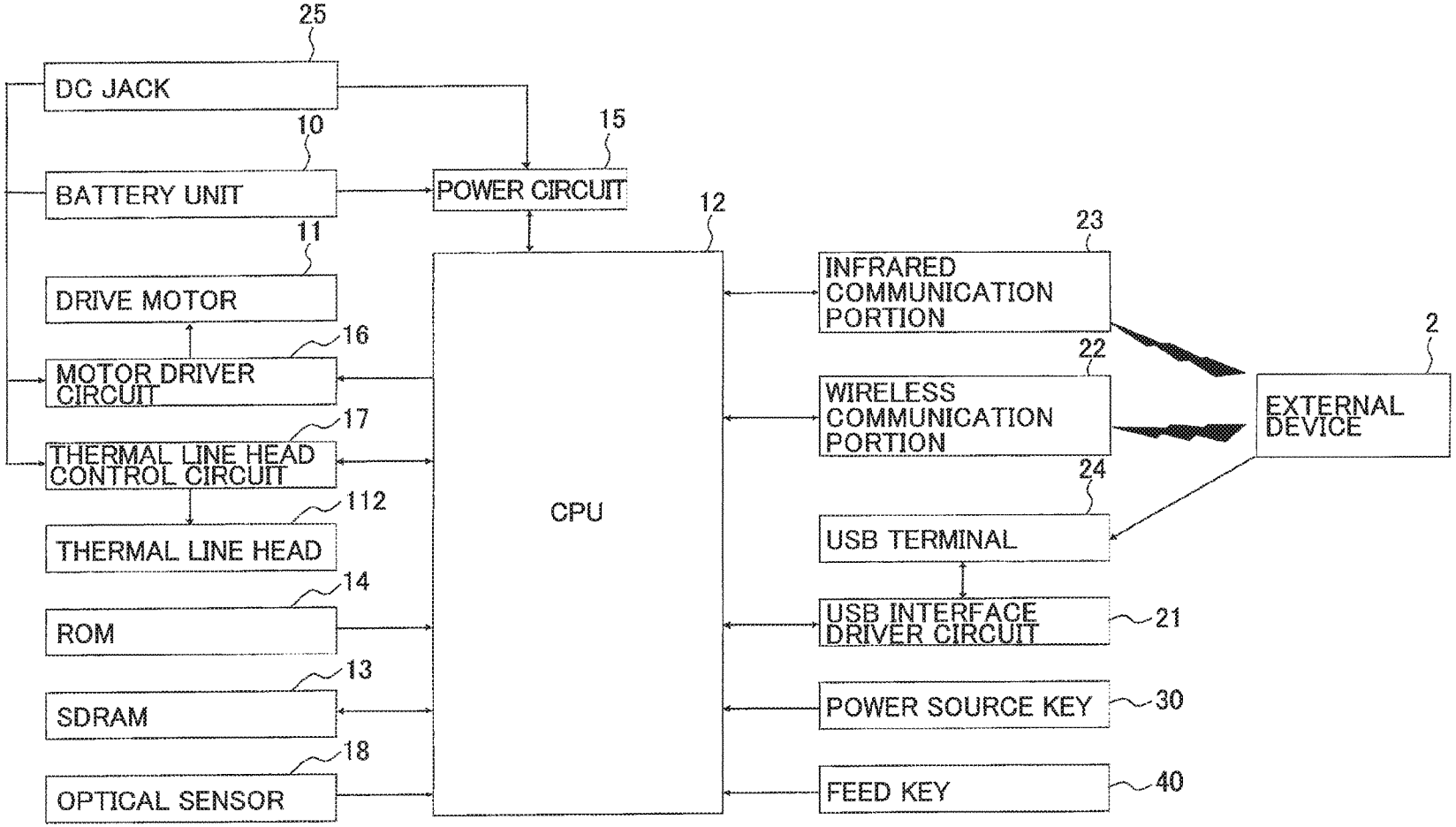
FIG. 4 is a block diagram illustrating a control system in the printer.

Incidentally, arrows shown in FIG. 4 indicate flowing direction of signals. However, flowing direction is not limited to the embodiment.

While the description has been made in detail with reference to specific embodiment(s) thereof, it would be apparent to those skilled in the art that various changes and modifications may be made therein without departing from the spirit and scope of the above described embodiment(s).

What is claimed is:

1. A printer comprising:

a casing formed with an opening;

a platen roller provided in the casing and configured to convey a sheet, the platen roller having an axis extending in an axial direction;

a thermal line head provided in the casing at a position in confrontation with the platen roller to provide a confronting portion between the thermal line head and the platen roller;

a guide member provided in the casing and providing an inlet passage that guides the sheet inserted through the opening toward the confronting portion, the guide member having a surface facing the inlet passage, and comprising:

a plurality of ribs protruding from the surface toward the inlet passage and spaced away from each other at a predetermined interval in the axial direction, the plurality of ribs being configured to contact the sheet in the inlet passage to guide the sheet; and a flat surface portion facing the inlet passage and positioned at a portion other than the plurality of ribs;

an optical sensor provided in the casing at a position in confrontation with the inlet passage, the optical sensor being configured to optically detect the sheet inserted through the opening and guided by the guide member;

a controller configured to control the platen roller and the thermal line head based on a result of sheet detection by the optical sensor; and a light shielding member provided in the casing and protruding toward the inlet passage at a position closer to the opening than the optical sensor to the opening, the light shielding member having a protruding end in intimate contact with the flat surface portion.

2. The printer according to claim 1, wherein the plurality of ribs have protruding end faces substantially flush with the flat surface portion.

3. The printer according to claim 1, wherein the surface of the guide member has a recessed portion at a position in confrontation with the optical sensor, the flat surface portion being positioned closer to the opening than the recessed portion to the opening.

4. The printer according to claim 3, wherein the flat surface portion has one end and another end farther from the opening than the one end to the opening; and wherein the plurality of ribs include a group of ribs continuous with the one end of the flat surface portion.

5. The printer according to claim 1, wherein each of the plurality of ribs has a thickness in the axial direction, the thickness being substantially equal to the predetermined interval.

6. The printer according to claim 1, wherein the casing has a rectangular parallelepiped shape assuming that its longitudinal direction is a leftward/rightward direction, one short side direction is an upward/downward direction, and another short side direction is a frontward/rearward direction, the casing having an upper surface extending in the leftward/rightward direction and the frontward/rearward direction, the opening being open at the upper surface and extending in the leftward/rightward direction;

wherein the platen roller extends in the leftward/rightward direction which is the axial direction, and has a left end portion and a right end portion rotatably supported to the casing; and wherein the thermal line head extends in the leftward/rightward direction and faces the platen roller in the upward/downward direction.

7. The printer according to claim 6, wherein the casing has a front side formed with a discharge opening extending in the leftward/rightward direction, the discharge opening being configured to discharge the sheet on which an image is formed by the thermal line head to outside of the casing.

8. The printer according to claim 6, wherein the casing has a first cover constituting an upper portion of the casing, a second cover constituting a lower portion of the casing, and an opening/closing cover provided at a front side of the first cover, the opening/closing cover having a portion facing the inlet passage and configured to be moved between an open position and a closed position;

wherein the opening is defined between the first cover and the opening/closing cover;

wherein the guide member is supported to the second cover;

wherein the optical sensor is provided at the portion of the opening/closing cover; and wherein the light shielding member is provided at the portion of the opening/closing cover at a position closer to the opening than the optical sensor to the opening, the protruding end of the light shielding member being in intimate contact with the flat surface portion at the closed position of the opening/closing cover.

9. The printer according to claim 8, wherein the casing further has a frame supported by the second cover; and wherein the guide member is supported to the frame.

* * * * *